United States Patent [19]

Okui et al.

[11] Patent Number: 5,063,897

[45] Date of Patent: Nov. 12, 1991

[54] ACCESSORY DRIVE ARRANGEMENT FOR ENGINE

[75] Inventors: Kaoru Okui; Manabu Kobayashi, both of Iwata, Japan

[73] Assignee: Yamaha Hatsudoki Kabushiki Kaisha Yamaha Motor Co., Ltd., Iwata, Japan

[21] Appl. No.: 548,019

[22] Filed: Jul. 5, 1990

Related U.S. Application Data

[63] Continuation-in-part of Ser. No. 270,357, Nov. 14, 1988, Pat. No. 5,024,287, and a continuation-in-part of Ser. No. 346,545, May 2, 1989.

[30] Foreign Application Priority Data

Jul. 6, 1989 [JP] Japan ..... 1-174676

[51] Int. Cl.[5] ..... F02B 77/00

[52] U.S. Cl. ..... 123/198 R; 123/195 A

[58] Field of Search ..... 123/59 R, 59 A, 59 NB, 123/195 A, 195 C, 198 R; 180/297

[56] References Cited

U.S. PATENT DOCUMENTS 1,312,555 8/1919 McCain ..... 123/195 A
2,226,596 12/1940 Swenson ..... 123/195 A
3,613,645 10/1971 Froumajou ..... 123/195 A
3,719,178 3/1973 Stewart ..... 123/195 A
4,114,586 9/1978 Fujikawa et al. ..... 123/195 A

FOREIGN PATENT DOCUMENTS 1199885 12/1959 France ..... 123/41.49

*Primary Examiner*—Noah P. Kamen
*Attorney, Agent, or Firm*—E. A. Beutler

[57] ABSTRACT

A vehicle and drive unit therefor including a transversely disposed engine located in an engine compartment. The cylinders are inclined to the rear from a vertical plane at an acute angle and the engine crankshaft drives an accessory shaft that rotates in a plane disposed at an acute angle to the vertical and forwardly of the cylinder axis and at an acute angle to the cylinder axis. Accessories are driven from this accessory shaft as are the front wheel axles which lie on the opposite side of the plane containing the cylinder axis from the output shaft axis. The accessory drive is disposed inwardly of the ends of the engine so as to provide a compact body and the engine body is recessed to receive the accessory drive so as to minimize the distance between the accessory shaft and the engine crankshaft.

18 Claims, 6 Drawing Sheets

ACCESSORY DRIVE ARRANGEMENT FOR ENGINE

CROSS REFERENCE TO RELATED APPLICATIONS

This application is a continuation in part of our applications Ser. No. 270,357, filed Nov. 14, 1988, entitled "Engine Unit For Vehicles", now U.S. Pat. No. 5,024,287, and Ser. No. 346,545, filed May 2, 1989, entitled "Front Wheel Drive Engine", which applications are assigned to the Assignee hereof.

BACKGROUND OF THE INVENTION

This invention relates to an accessory drive arrangement for an engine and more particularly to an improved, compact engine construction and accessory drive arrangement therefor.

As is well known, engines and particularly those for motor vehicles are becoming extremely complicated in nature and include a wide variety of accessories driven by the engine, both necessary for engine operation and also accessories that are not a portion of the engine but are employed in connection with the motor vehicle, such as air conditioning compressors, power steering pumps and the like. Because of the complexity of the engine coupled with the tendency to make engine compartments smaller and more compact for streamlining purposes, it is becoming very difficult to drive all of the accessories in a compact arrangement and still afford servicing.

It is, therefore, a principal object of this invention to provide an accessory drive arrangement for an engine which will permit a compact construction and ease of servicing.

It is a further object of this invention to provide an accessory drive arrangement ,for an engine in which the accessories may be positioned between the ends of the engine and hence do not add to the overall length of the engine.

It is a further object of this invention to provide an accessory drive arrangement for an engine wherein the engine may be employed in a transverse position in the engine compartment of the vehicle and still not require additional engine compartment space.

SUMMARY OF THE INVENTION

This invention is adapted to be embodied in an internal combustion engine having an engine body rotatably journaling an output shaft, an accessory shaft is driven by the engine output shaft and has a portion exposed externally of the engine body, an accessory drive is affixed to the exposed accessory shaft portion at a longitudinal point on the engine between the ends of the engine output shaft for driving an accessory external of the engine body.

DETAILED DESCRIPTION OF THE PREFERRED EMBODIMENTS OF THE INVENTION

Figure 1:
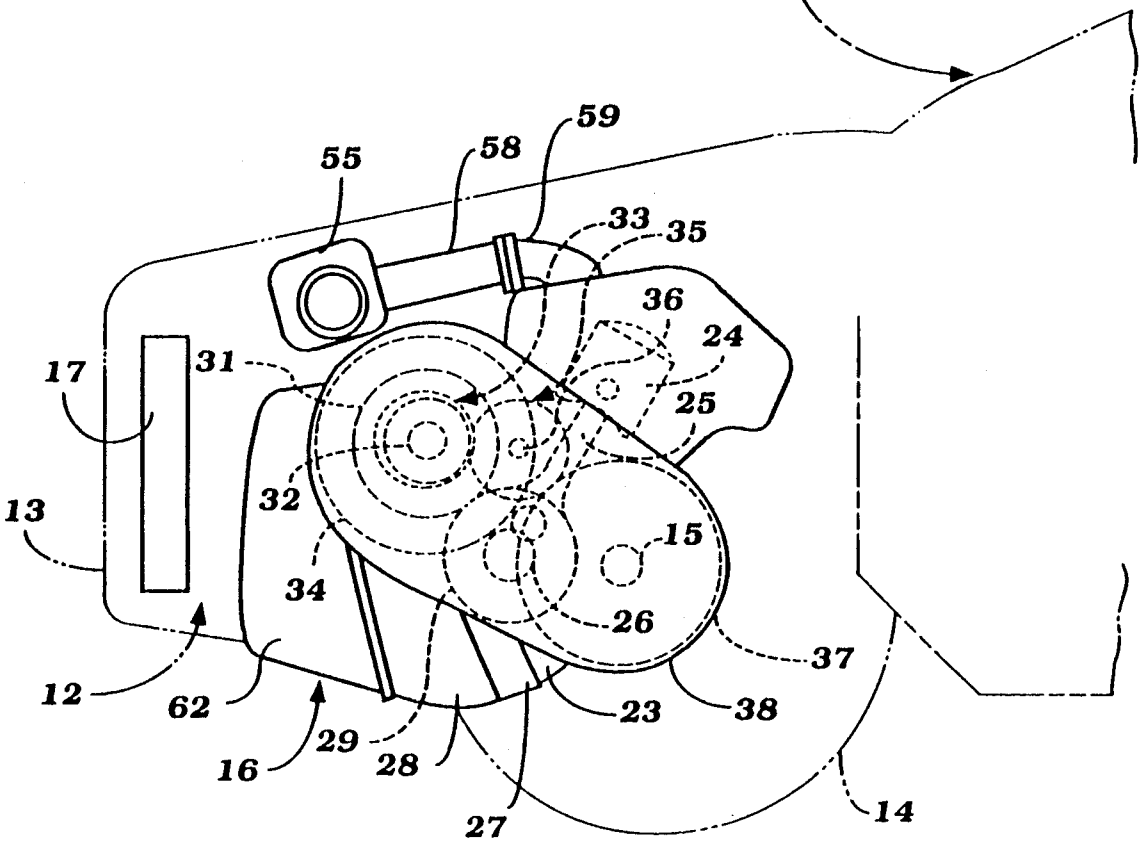
FIG. 1 is a side elevational view of a portion of a motor vehicle embodying an engine construction in accordance with an embodiment of the invention, with portions of the vehicle shown in phantom.
Figure 2:
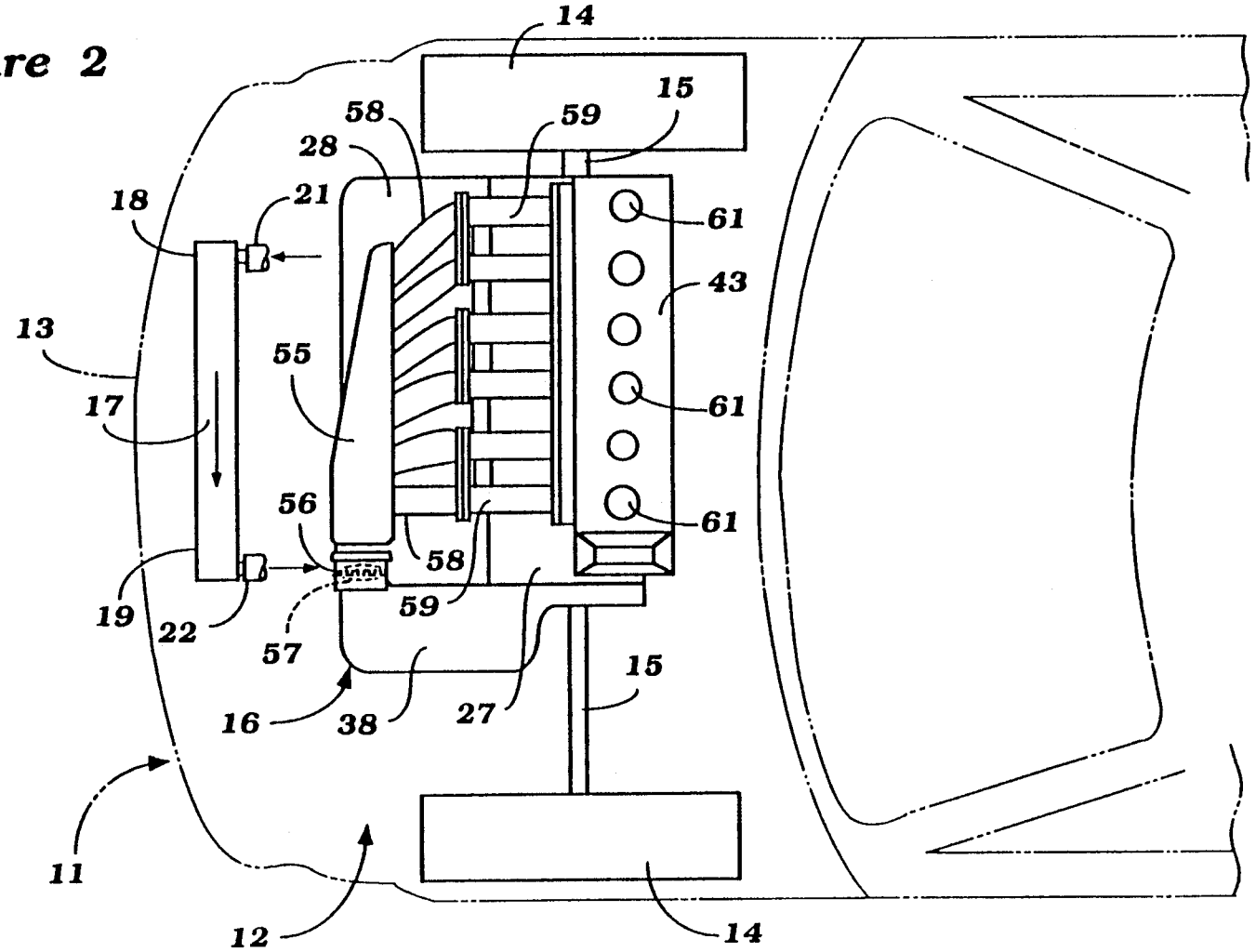
FIG. 2 is a top plan view of the portion of the vehicle shown in FIG. 1 with portions of the vehicle shown in phantom.

Referring first in detail to FIGS. 1 and 2, a motor vehicle powered by an engine construction in accordance with an embodiment of the invention is shown primarily in phantom and is identified generally by the reference numeral 11. Only the portion of the motor vehicle Il associated with the engine compartment has been illustrated because the invention deals with the engine construction and its placement in this engine compartment and the accessory drive arrangement therefor.

In the illustrated embodiment, the vehicle 11 is of the front engine transversely disposed front wheel type and has an engine compartment 12 that extends transversely across the front of the motor vehicle 11 and which is positioned rearwardly of an air inlet opening 13 which is formed in the body of the vehicle forwardly of the engine compartment 12. A pair front wheels 14 are suspended by the chassis of the vehicle 11 in a known manner and have associated with them axle shafts 15 which are driven in a manner to be described.

A power unit, indicated generally by the reference numeral 16 and which is comprised of an internal combustion engine, a change speed transmission, and a final drive, is positioned transversely in the engine compartment 12 for driving the axle shafts 15. Basically, the power unit 16 has a construction as described in our aforenoted copending application Ser. No. 270,357 and specifically the embodiment of FIGS. 6 through 8 thereof. Because of the basic similarity of the engine of this embodiment to that of the previously described embodiment, certain components have not been illustrated fully, nor will they be described in full detail. Where that is the case, reference may be had to the aforenoted copending application, the disclosure of which is incorporated herein by reference.

A radiator 17 of the cross flow type is positioned transversely in the engine compartment 12 directly behind the air inlet opening 13. As a cross flow radiator, the radiator 17 has header tanks 18 and 19 disposed at its opposite ends which receive coolant from the power unit 16 through a hose 21 and which return coolant to the power unit 16 through a hose 22. Other components of the cooling system will be described hereinafter.

Figure 5:
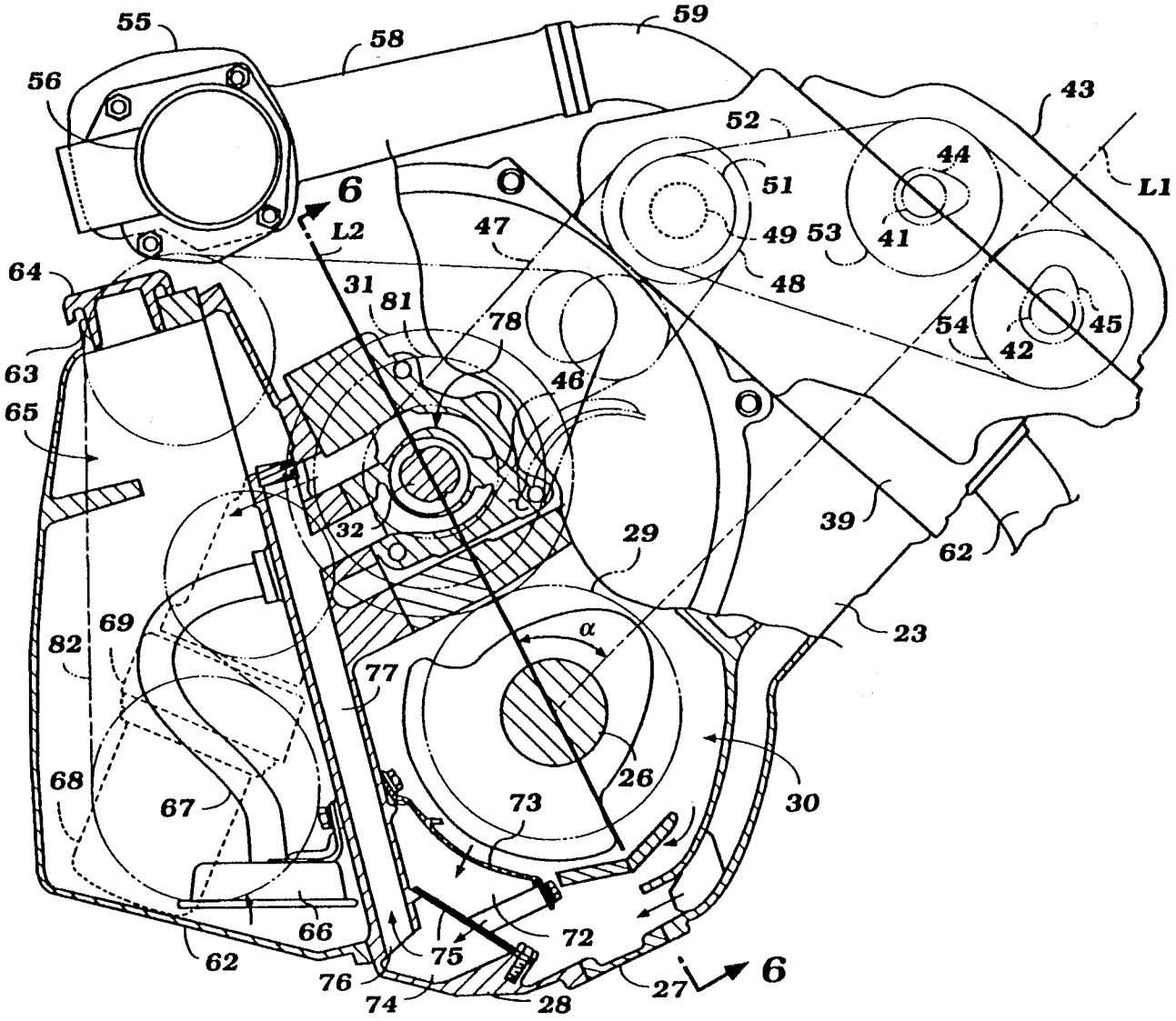
FIG. 5 is a side elevational view, in part similar to FIG. 1, on an enlarged scale and with portions broken away.

The engine portion of the power unit 16 includes a cylinder block 23 that is provided with a plurality of aligned cylinder bores in which pistons 24 reciprocate. The cylinder bores in which the pistons 24 reciprocate are inclined from the vertical rearwardly away from the engine compartment air inlet opening 13 along a line L1 as best seen in FIG. 5. In the illustrated embodiment, the engine has six cylinders although is to be understood that the invention can be practiced with engines having other numbers of cylinders. The pistons 24 are connected by means of connecting rods 25 for driving a crankshaft 26 that is rotatable about an axis that lies on the line L1 and which is disposed at the lower ends of the cylinders. The crankshaft 26 is rotatably journaled in a known manner.

A first crankcase portion 27 is affixed to the cylinder block 23 at its lower end. However, because of the angular disposition of the cylinder block 23, the crankcase portion 27 extends generally vertically along a line that is disposed at an acute angle to the vertical but which extends forwardly of a vertically extending plane from the line L1. This plane is generally designated by the line L2 and lies at an acute $\alpha$ to the plane L2. A further crankcase portion 28 is affixed to the portion 27 and also extends vertically upward and is disposed forwardly of the crankcase portion 27. The portions 27 and 28 and the cylinder block 23 define a crankcase chamber 30 in which the crankshaft 26 rotates.

Figure 6:
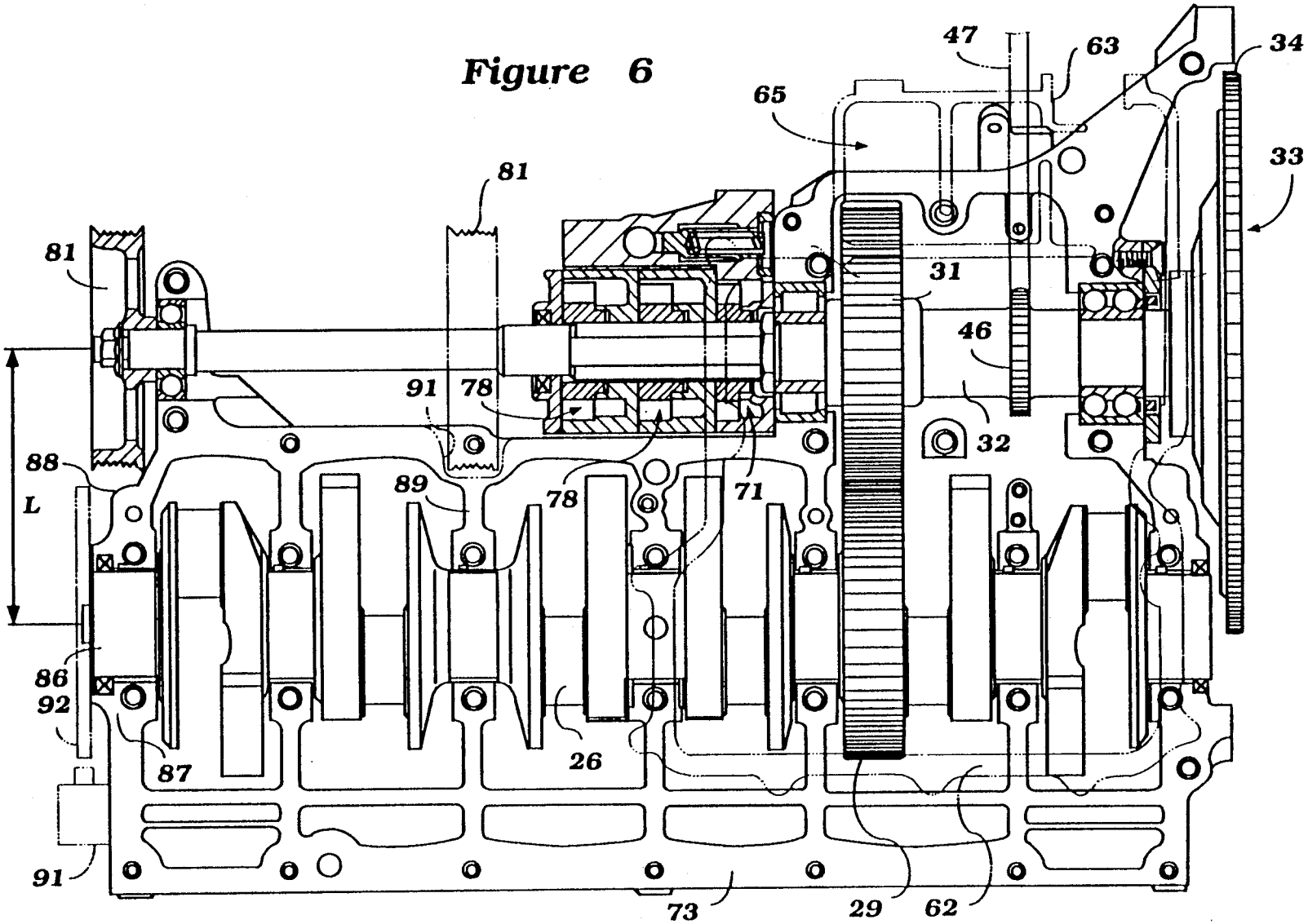
FIG. 6 is a cross sectional view taken along the line 6—6 of FIG. 5.

As may be seen in FIG. 6, one of the cheeks of the crankshaft 26 is formed with an integral gear portion 29 which is enmeshed with a gear 31 that is affixed to or associated with an accessory or output shaft 32. The accessory or output shaft 32 is supported for rotation by the cylinder block 23 and crankcase portion 27 for rotation about an axis that is disposed parallel to the axis of rotation of the crankshaft 26 and the axle shafts 15, but which lies on the line L2. The line L2 is disposed at an acute angle, as aforenoted, to a vertically extending plane and at an acute angle $\alpha$ relative to the plane L1. This acute angle relationship permits a very compact engine, accessory and final drive assembly, as will become apparent With the prior art type of constructions and specifically that shown in our copending application Ser. No. 270,257, the output shaft axis 32 is disposed forwardly and at least at a right angle to the cylinder bore axis defined by the line L1. As a result, this axis is disposed at a relatively low height from the vertical and forwardly of the crankshaft axis. However, by disposing the output shaft angle 32 at an acute angle to the plane L1, the height is raised but the horizontal length of the engine is substantially reduced. As a result and as will be described, this permits a more compact assembly.

A flywheel, indicated generally by the reference numeral 33 and having a starter gear 34 is affixed for rotation with the output shaft 32. The flywheel 33 is associated with a clutch (not shown) as described in our aforenoted application Ser. No. 270,357 for driving a primary shaft of a change speed transmission, indicated generally by the reference numeral 35. The change speed transmission 35 includes a secondary shaft 36 and a plurality of intermeshing gear sets.

The gear sets are contained on the transmission primary shaft and secondary shaft 36 for driving the secondary shaft 36 from the primary shaft at selected speed ratios. The secondary shaft 36 drives an input gear 37 of a differential assembly for driving the axle shafts 15 in a well known manner.

It should be noted that the acute angle between the lines L1 and L2 and the close positioning of the transmission secondary shaft 36 to the line L1 permits a very compact final drive assembly and keeps the distance between the primary shaft of the transmission 35 and the axis of rotation of the axle shafts 15 very close to each other. The close positioning of the output shaft axis and the axles 15 also makes it possible to use smaller diameter gears for the final drive and this further adds to the compactness of the assembly. A transmission casing cover 38 encloses the portion of the transmission which has been described for driving the axle shafts 15. This cover 38 is affixed to the cylinder block 23 and crankcase portions 27 and 28 in a suitable manner.

A cylinder head 39 is affixed in a known manner to the upper end of the cylinder block 23 and closes the cylinder bores in which the pistons 24 reciprocate. Overhead mounted intake and exhaust valves, as described in our copending application Ser. No. 270,357, are mounted in the cylinder head 39 for controlling the admission of an intake charge and the exhaust of the burnt charge. These valves are operated by means of an intake camshaft 41 and an exhaust camshaft 42 that are journaled on the cylinder head assembly 39 and which are enclosed within a cam chamber closed by a cam cover 43. The camshafts 41 and 42 have respective cam lobes 44 and 45 for operating the intake and exhaust valves in the manner described in our aforenoted copending patent application.

A camshaft drive sprocket 46 (FIGS. 5 and 6) is formed integrally on the accessory or output shaft 32 and drives a first timing chain 47. The first timing chain 47, in turn, drives a sprocket 48 that is affixed to an intermediate cam drive shaft 49. The cam drive shaft 49 is journaled in an appropriate manner on the cylinder head 39 and, in turn, drives a second sprocket 51. A second chain 52 drives a pair of driven sprockets 53 and 54 that are affixed to the camshafts 41 and 42 respectively for driving these camshafts. As noted in our aforenoted copending application, the two to one speed reduction between the crankshaft 26 and camshafts 41 and 42 may be achieved in stages through the camshaft drive mechanism as aforedescribed. Because this mechanism is described in more detail in our copending application, further description of it in this application is not believed to be necessary.

Figure 4:
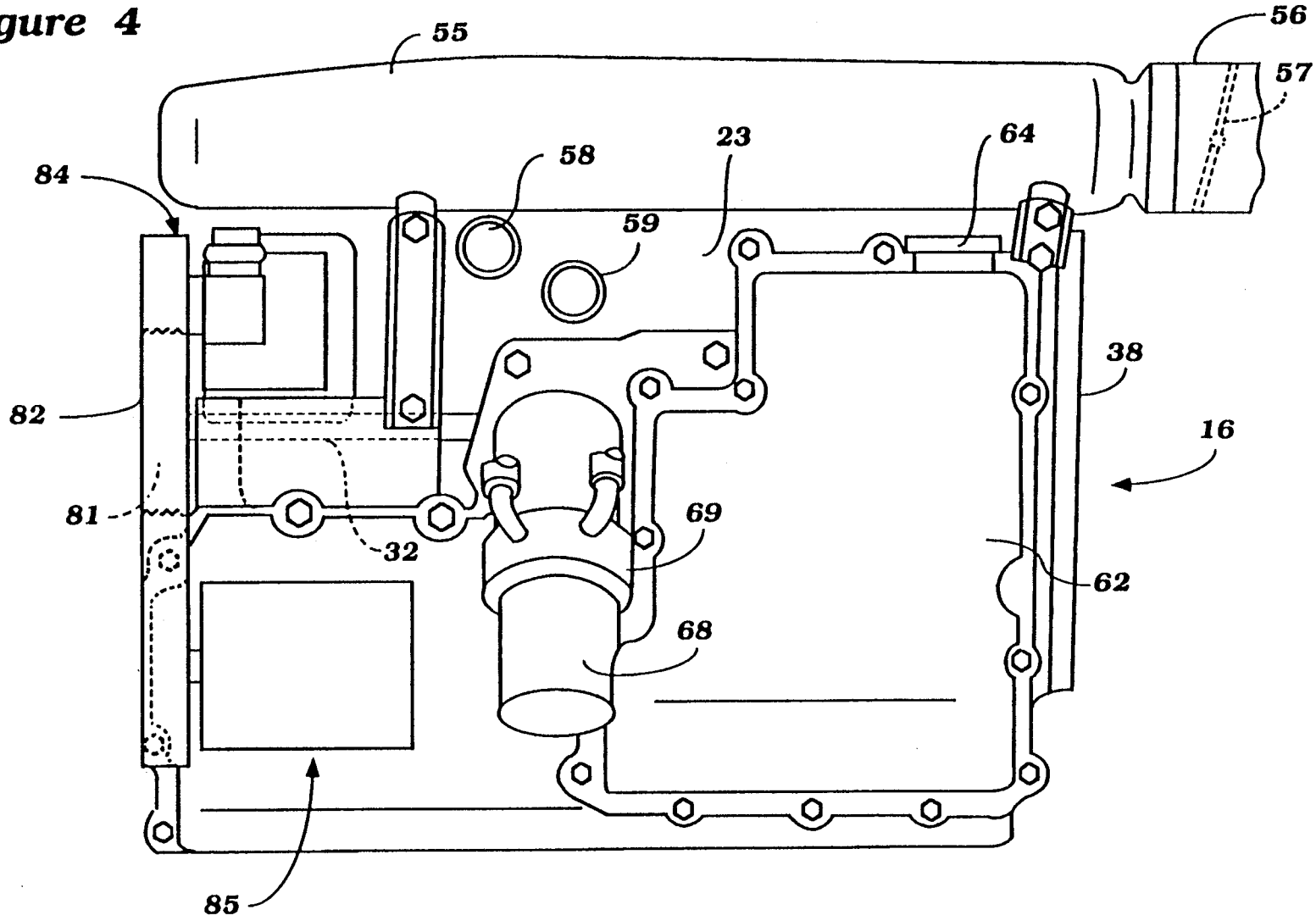
FIG. 4 is an enlarged front elevational view of the engine.

The intake valves, as aforedescribed, are associated with an air induction system that includes a plenum chamber 55 that extends transversely across the engine compartment 12 forwardly of the cylinder head and cylinder block 23. The plenum chamber 55 is provided with an air inlet portion 56 in which a throttle valve 57 (FIGS. 2 and 4) is positioned for controlling the engine speed. Air is delivered to the inlet section 56 from a remotely positioned air cleaner and silencer assembly (not shown).

The plenum chamber 55 has either affixed to it or formed integrally with it a plurality of runners 58 that cooperate with manifold pipes 59 which serve the individual cylinders of the engine and specifically the intake ports of the cylinder head 39 in a known manner.

Spark plugs (not shown) are contained within spark plug pockets 61 formed in the cam cover 43 and are in turn threaded into the cylinder head 39 for firing the charge admitted to the combustion chambers of the engine. The ignition system for firing these spark plugs may be of any known type. The burnt exhaust gases are then discharged through the exhaust ports of the cylinder head 39 to an exhaust manifold, shown partially and indicated by the reference numeral 62.

The engine is provided with a dry sump lubrication system that includes a dry sump lubricant reservoir 62 that is supported from the crankcase member 28 and which extends forwardly of the engine and vertically upwardly in the area to the rear of the air inlet opening 13 to the engine compartment 12. The top of the reservoir 62 has a filler neck 63 to Which a detachable cap 64 is attached. The tank 62 has a large internal volume 65 and the filler neck 63 and a portion of the volume 65 extends upwardly beyond the axis of rotation of the engine output shaft 32. As a result, the tank 62 has a large surface area that will be exposed to the cooling air flow. This will insure that the lubricant is well cooled. The greater height and larger volume for the dry sump lubricant reservoir 62 is made possible because of the acute angle relationship between the planes L1 and L2 which has been previously discussed. This permits the tank 62 to be positioned rearwardly in the engine compartment and can have a significant height without adversely effecting the hood line of the vehicle.

A lubricant pressure pump 71 (FIG. 6) of the tricodal type is driven by the accessory shaft 32 and draws oil from the lower portion of the tank 62 through a strainer inlet 66. A conduit 67 extends from the strainer inlet 66 to the inlet side of the pressure pump 71. Lubricant is then delivered from the pressure pump 71 to an oil filter 68 that is mounted on the front of the crankcase casing 28 with an oil cooler 69 being interposed between it and the crankcase member 28. The oil cooler 69 receives coolant from the cooling system including the radiator 17. The lubricant is then delivered to the various components of the engine for their lubrication in a suitable manner.

The lubricant will then return to the crankcase chamber 30 by gravity flow and specifically to an area 72 positioned below a baffle plate 73. The baffle plate 73 is juxtaposed to the crankshaft 26 so as to control the oil flow in this area. The oil will then drain to a well 74 formed below a screen 75. This oil is then picked up by the inlet 76 of a scavenge line 77 that is formed in the crankcase portion 28 for delivery to a pair of scavenge pump assemblies 78. The scavenge pump assemblies 78 are driven from the accessory shaft 32 and are also of the tricodal type. The scavenged oil is then returned to the dry sump tank 62 through a return conduit 79.

An accessory drive pulley 81 is affixed to the end of the accessory or output shaft 32 opposite to the flywheel 33 and drives a belt 82. The belt 82 drives a plurality of accessories such as an alternator 83, power steering pump 84 and air conditioning compressor 85. As may be seen from FIG. 6, the accessory drive pulley 81 is affixed to the accessory drive shaft 32 at a point that is inwardly of the adjacent bearing end 86 of the crankshaft 26 which bearing end is supported in a boss 87 of the cylinder block 23 and crankcase.

There is provided a recess 88 adjacent this area so as to permit the accessory drive shaft 32 to rotate about an axis that is disposed at a very close distance to the axis of rotation of the crankshaft 26 as shown by the dimension L in FIG. 6. This arrangement also insures that the engine will have a short overall length and that the accessories which are mounted externally of the engine are disposed between its ends to provide a compact assembly. However, due to the angular disposition of the cylinder block 23 and the bores therein, these accessories are readily available for servicing.

It should be noted that the portion of the output or accessory shaft 32 that is driven by the crankshaft 26 and which drives the camshaft mechanism is disposed internally of the body of the engine and specifically of the cylinder block 23. However, the portion of the shaft 32 which drives the pulley 81 and pumps 71 and 78 is external of this body.

As an alternative location for the pulley 81, it may be mounted even more inwardly of the ends of the crankshaft 26, for example, adjacent one of the intermediate bosses 89 that support the crankshaft 26 as shown in phantom in FIG. 6. In this event, the cylinder block 23 and associated crankcase components will be provided with a relief 91 so as to clear the pulley 81.

Figure 3:
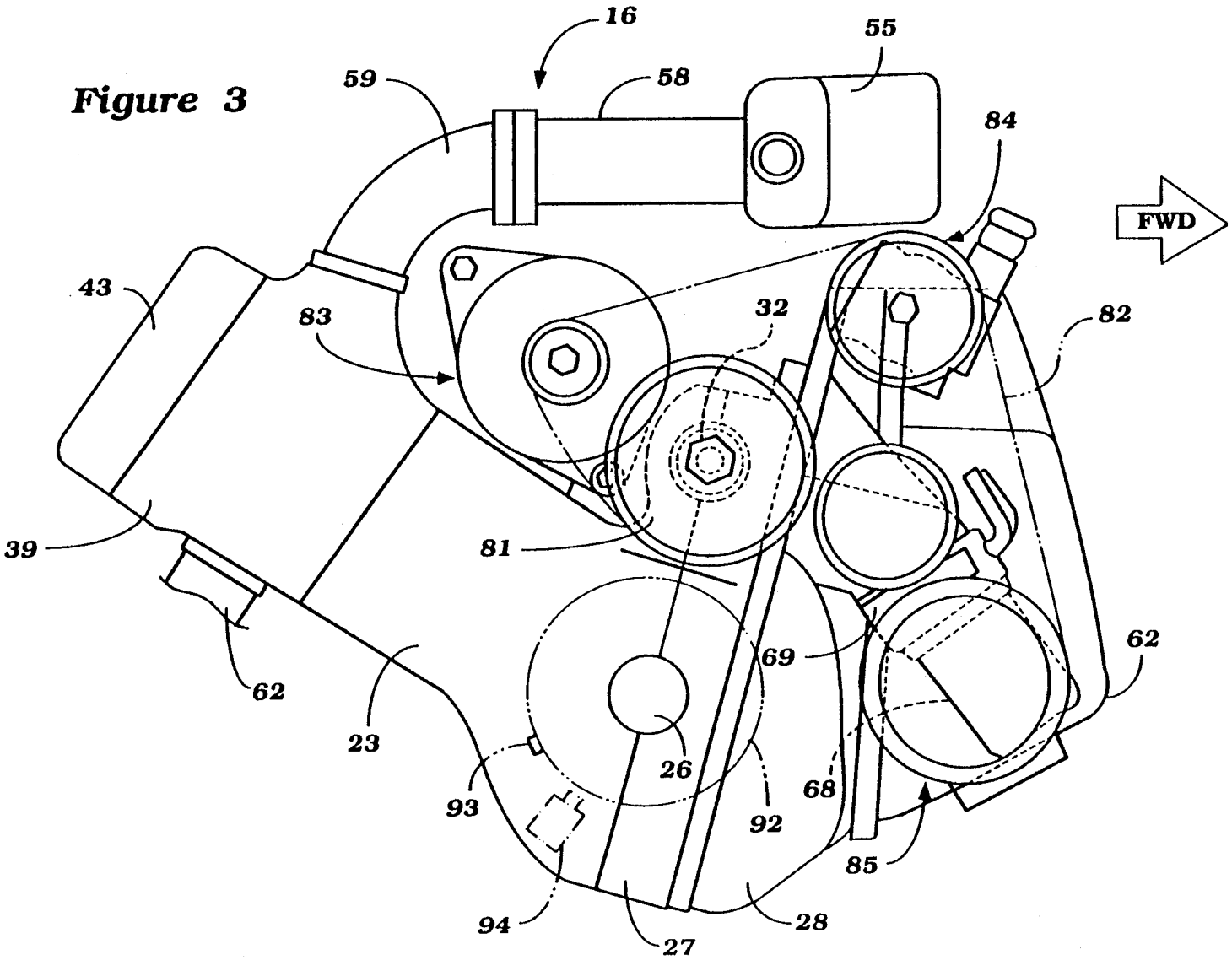
FIG. 3 is an enlarged side elevational view of the engine unit looking in the direction opposite to that shown in FIG. 1.

In conjunction with the ignition system for the engine, a timer disk or wheel 92 (FIGS. 3 and 6) is affixed to the end of the crankshaft 26 adjacent the accessory drive pulley 81 and carries a marker 93 that cooperates with a fixed pulser coil 94 so as to provide an indication of crankshaft rotation.

It should be readily apparent from the foregoing description that the described construction provides an extremely compact engine assembly and accessory drive therefor but nevertheless one which provides an adequate space for servicing. It is to be understood that the foregoing description is that of preferred embodiments of the invention and that various changes and modifications may be made without departing from the spirit and scope of the invention, as defined by the appended claims.

We claim:

1. An internal combustion engine for a motor vehicle, said having an engine body rotatably journaling an output shaft, an accessory shaft driven by said engine output shaft internally of said engine body and between the end of said output shaft and having a portion exposed externally of said engine body, and an accessory drive affixed to said exposed accessory shaft portion at a longitudinal point of the engine between the ends of the engine output shaft for driving an accessory external of said engine body, and a transmission for said motor vehicle driven from the end of said accessory shaft opposite to where said accessory drive is positioned.

2. An internal combustion engine as set forth in claim 1 wherein the engine has a plurality of aligned cylinders transversely disposed within an engine compartment of the motor vehicle.

3. An internal combustion engine as set forth in claim 2 wherein the cylinders are inclined rearwardly from the vertical at an acute angle.

4. An internal combustion engine as set forth in claim 3 wherein the accessory shaft is positioned forwardly of the cylinders.

5. An internal combustion engine as set forth in claim 4 wherein the accessory driven by the accessory drive is an accessory that is not required by the engine for its operation.

6. An internal combustion engine for a motor vehicle, said engine having an engine body rotatably journaling an output shaft, an accessory shaft driven by said engine output shaft and having a portion exposed externally of said engine body an accessory drive affixed to said exposed accessory shaft portion at a longitudinal point of the engine between the ends of the engine output shaft for driving an accessory external of said engine body, and a transmission for said motor vehicle driven from the end of said accessory shaft opposite to where said accessory drive is positioned.

7. An internal combustion engine as set forth in claim 6 wherein the engine has a plurality of aligned cylinders transversely disposed within an engine compartment of the motor vehicle.

8. An internal combustion engine as set forth in claim 7 wherein the cylinders are inclined rearwardly from the vertical at an acute angle.

9. An internal combustion engine as set forth in claim 8 wherein the accessory shaft is positioned forwardly of the cylinders.

10. An internal combustion engine as set forth in claim 9 wherein the accessory driven by the accessory drive is an accessory that is not required by the engine for its operation.

11. An internal combustion engine as set forth in claim 10 wherein the accessory driven by the accessory drive is an accessory that is not required by the engine for its operation.

12. An internal combustion engine as set forth in claim 11 wherein accessory drive shaft is driven by the engine output shaft between the ends of the engine output shaft.

13. An internal combustion engine as set forth in claim 11 wherein the engine has a plurality of aligned cylinders transversely disposed within the engine compartment.

14. An internal combustion engine as set forth in claim 13 wherein the cylinders are inclined rearwardly from the vertical at an acute angle.

15. An internal combustion engine as set forth in claim 14 wherein the accessory shaft is positioned forwardly of the cylinders.

16. An internal combustion engine having an engine body, a plurality of aligned cylinders and a crankshaft driven from pistons slidably supported within said cylinders, said crankshaft having a plurality of longitudinally spaced bearings for rotatably journaling said output shaft, said engine body including a crankcase in which said crankshaft is rotatably journaled, an accessory shaft driven by said crankshaft and having a portion exposed externally of said engine body, and an accessory drive affixed to said exposed accessory shaft portion at a longitudinal point of the engine between the ends said crankshaft for driving an accessory external of said engine body, said accessory drive being positioned adjacent one of said crankshaft journals said crankcase having a recess formed adjacent said one crankshaft journal for clearance for said accessory drive so as to minimize the distance between the accessory shaft and said crankshaft.

17. An internal combustion engine as set forth in claim 16 wherein the bearing adjacent the accessory drive is an end bearing of the crankshaft.

18. An internal combustion engine as set forth in claim 16 wherein the bearing adjacent the accessory drive comprises an intermediate bearing of the crankshaft.

* * * * *